United States Patent [19]

Gullotti et al.

[11] Patent Number: 4,524,820

[45] Date of Patent: Jun. 25, 1985

[54] APPARATUS FOR PROVIDING IMPROVED SLURRY CAST STRUCTURES BY HOT WORKING

[75] Inventors: Damian V. Gullotti, Cheshire; Joseph Winter, New Haven, both of Conn.; Kenneth P. Young, Ballwin; Robert D. Evans, Manchester, both of Mo.

[73] Assignee: International Telephone and Telegraph Corporation, New York, N.Y.

[21] Appl. No.: 363,621

[22] Filed: Mar. 30, 1982

[51] Int. Cl.[3] ..... B22D 11/12

[52] U.S. Cl. ..... 164/476; 164/900

[58] Field of Search ..... 164/476, 76.1, 900; 148/2

[56] References Cited

U.S. PATENT DOCUMENTS

| | | | |
|---|---|---|---|
| 2,249,349 | 7/1941 | Deutsch | 148/12.7 R |
| 2,861,302 | 11/1958 | Mann et al. | 164/499 |
| 2,963,758 | 12/1960 | Pestel et al. | 164/5 |
| 3,268,963 | 8/1966 | Mann | 164/493 |
| 3,317,994 | 5/1967 | Cofer et al. | 164/476 |
| 3,902,544 | 9/1975 | Flemings et al. | 164/485 |
| 3,936,298 | 2/1976 | Mehrabian et al. | 148/400 |
| 3,948,650 | 4/1976 | Flemings et al. | 420/590 |
| 3,954,455 | 5/1976 | Flemings et al. | 148/400 |
| 3,988,180 | 10/1976 | Bouvaist | 148/159 |
| 3,995,678 | 12/1976 | Zavaras et al. | 164/499 |
| 4,019,927 | 4/1977 | Bouvaist | 148/11.5 A |
| 4,030,534 | 6/1977 | Ito et al. | 164/499 |
| 4,040,467 | 8/1977 | Alberny et al. | 164/499 |
| 4,042,007 | 8/1977 | Zavaras et al. | 164/499 |
| 4,042,008 | 8/1977 | Alberny et al. | 164/504 |
| 4,051,887 | 10/1977 | Groth et al. | 164/476 |
| 4,106,956 | 8/1978 | Bercovici | 148/11.5 A |
| 4,150,712 | 4/1979 | Dussart | 164/443 |
| 4,229,210 | 10/1980 | Winter et al. | 164/505 |
| 4,372,369 | 2/1983 | Flemings et al. | 164/900 X |

FOREIGN PATENT DOCUMENTS

| | | | |
|---|---|---|---|
| 2707774 | 9/1977 | Fed. Rep. of Germany . | |
| 52-9612 | 1/1977 | Japan | 164/476 |
| 56-136265 | 10/1981 | Japan | 164/476 |
| 1525036 | 9/1978 | United Kingdom . | |
| 1525545 | 9/1978 | United Kingdom . | |

OTHER PUBLICATIONS

Flemings, M. C. et al., "Rheocasting Processes", *AES International Cast Metals Journal*, Sep. 1976, pp. 11–22.

Fascetta, E. F. et al., "Die Casting Partially Solidified High Copper Content Alloys", *AFS Cast Metals Research Journal*, Dec. 1973, pp. 161–171.

Szekely, J. et al., "Electromagnetically Driven Flows in Metals Processing", *Journal of Metals*, Sep. 1976, pp. 6–11.

*Primary Examiner*—Kuang Y. Lin

*Assistant Examiner*—J. Reed Batten, Jr.

*Attorney, Agent, or Firm*—James B. Raden; Harold J. Holt

[57] ABSTRACT

A process and apparatus for providing metal material having an improved structure for forming into a desired article is disclosed herein. The improved structure is obtained by slurry casting a material into a continuous member and then hot working the slurry cast material. Upon reheating to a semi-solid state, the hot worked, slurry cast material will exhibit finer particles and fewer eutectic melting rosettes than would be exhibited by the slurry as-cast material in an unworked and heated condition. The hot working of the slurry cast material produces an article having a deformed structure exhibiting directionality.

8 Claims, 9 Drawing Figures

APPARATUS FOR PROVIDING IMPROVED SLURRY CAST STRUCTURES BY HOT WORKING

The invention herein is directed to a process and apparatus for providing improved reheated structures for forming into a desired article.

In providing materials for later use in forming applications such as hot forging, it is known that materials formed from semi-solid thixotropic alloy slurries possess certain advantages. These advantages include improved part soundness as compared to conventional die casting. This results because the metal is partially solid as it enters a mold and, hence, less shrinkage porosity occurs. Machine component life is also improved due to reduced erosion of dies and molds and reduced thermal shock.

Methods for producing semi-solid thixotropic alloy slurries known in the prior art include mechanical stirring and inductive electromagnetic stirring. The processes for producing such a slurry with the proper structure require a balance between the shear rate imposed by the stirring and the solidification rate of the material being cast.

The mechanical stirring approach is best exemplified by reference to U.S. Pat. Nos. 3,902,544, 3,954,455, 3,948,650, all to Flemings et al. and 3,936,298 to Mehrabian et al. The mechanical stirring approach is also described in articles appearing in *AFS International Cast Metals Journal,* September, 1976, pages 11–12, by Flemings et al. and *AFS Cast Metals Research Journal,* December, 1973, pages 167–171, by Fascetta et al. In German OLS No. 2,707,774 published Sept. 1, 1977 to Feurer et al., the mechanical stirring approach is shown in a somewhat different arrangement.

In the mechanical stirring process, the molten metal flows downwardly into an annular space in a cooling and mixing chamber. Here the metal is partially solidified while it is agitated by the rotation of a central mixing rotor to form the desired thixotropic metal slurry for casting.

Inductive electromagnetic stirring has been proposed in U.S. Pat. No. 4,229,210 to Winter et al. Winter et al. use either AC induction or pulsed DC magnetic fields to produce indirect stirring of the solidifying alloy melt.

There is a wide body of prior art dealing with electromagnetic stirring techniques applied during the casting of molten metal and alloys. U.S. Pat. Nos. 3,268,963 to Mann, 3,995,678 to Zavaras et al., 4,030,534 to Ito et al., 4,040,467 to Alberny et al., 4,042,007 to Zavaras et al., 4,042,008 to Alberny et al., and 4,150,712 to Dussart as well as an article by Szekely et al. entitled "Electromagnetically Driven Flows in Metal Processing", September, 1976, *Journal of Metals,* are illustrative of the art with respect to casting metals using inductive electromagnetic stirring provided by surrounding induction coils.

The use of rotating magnetic fields for stirring molten metal during casting is known as exemplified in U.S. Pat. Nos. 2,963,758 to Pestel et al. and 2,861,302 to Mann et al. and U.K. Pat. Nos. 1,525,036 and 1,525,545. Pestel et al. disclose both static casting and continuous casting wherein the molten metal is electromagnetically stirred by means of a rotating field. One or more multi-poled motor stators are arranged about the mold or solidifying casting in order to stir the molten metal to provide a fine grained metal casting.

In U.S. Patent Application Ser. No. 15,250, filed Feb. 26, 1979 and now abandoned, to Winter et al., a rotating magnetic field generated by a two-pole multi-phase motor stator is used to achieve the required high shear rates for producing thixotropic semi-solid alloy slurries to be used in slurry casting.

Commercial requirements for small diameter feed stock of slurry cast metal involve a wide distribution of sizes. Below 1" in diameter, the economics of casting become questionable because of the necessarily low throughput rates. It is economically and technologically more advantageous to produce large bars and then reduce them to a variety of stock sizes. Machining to accomplish this, while possible, is wasteful. Cold working, which is feasible for some alloys, is not particularly suited to non-homogenized as-cast alloys such as aluminum alloys because of premature fracture. Furthermore, cold working tends to enhance homogenization. In as-cast alloys, cold work may be limited to as little as 8 to 15 percent prior to edge cracking and/or center bursts, depending upon the deformation mechanism.

The present invention comprises a process and apparatus for producing small diameter feed stock and for providing improved reheated slurry cast material for forming into a desired article. The process and apparatus of the instant invention utilize hot working of a slurry cast material, preferably without substantially affecting non-homogenization, prior to reheating of the material to a semi-solid state from which it is formed into an improved structure. The reheated, hot worked, slurry cast material has improved structural characteristics such as finer particles and fewer eutectic melting rosettes as compared to reheated, unworked slurry as-cast material.

Hot working, by its nature of breaking up and redistributing second phases, would not be normally considered a viable approach for reducing the cross-sectional area of a material which is to be reheated to the semi-solid slurry state prior to forming. The reheating to be effective in a subsequent forming operation must result in reconstitution of a structure characterized by discrete primary phase particles enveloped by solute-rich liquid. It was surprisingly found that a slurry cast material could be hot worked without engendering homogenization. In addition, it was found that the material, when reheated for final forming operations, exhibited good rehabilitation. Rehabilitation is defined as the return of the deformed material upon reheating to the semi-solid state to the preferred configuration typical of slurry cast materials in which rounded islands of primary phase particulate are surrounded by solute-rich liquid.

In accordance with the invention described herein, a metal or metal alloy having improved structural characteristics upon reheating to a semi-solid state which readily lends the metal or metal alloy to later forming processes is provided. This metal or metal alloy may be produced by slurry casting said metal or metal alloy into a continuous member having an initial cross-sectional area and a structure comprising islands of primary phase particles surrounded by a solute-rich matrix and thereafter hot working said slurry cast metal or metal alloy, preferably without engendering substantially any homogenization, while in a solid state to reduce said cross-sectional area. Hot working of the slurry cast metal or metal alloy causes the metal or metal alloy to have a deformed structure. Upon reheating to a semi-solid state, it has been found that the hot worked, slurry cast metal or metal alloy rehabilitates to a slurry as-cast type structure of islands of primary phase particles enveloped by a solute-rich matrix.

In a preferred embodiment, hot working is performed at a temperature above that at which center bursts and/or edge cracks form and below that at which the metal or metal alloy homogenizes upon high temperature reheating. Hot working is also performed so as to obtain a total reduction in cross-sectional area of about 40 percent to about 98 percent, preferably about 60 percent to about 96 percent. It has been found that by hot working within these ranges, the rehabilitated structures are superior to as-cast, reheated material in that there is a finer particulate size and fewer numbers of eutectic melting rosettes. By having such a rehabilitated structure at smaller than as-cast cross section, the desired end product may be produced in a more efficient manner.

Accordingly, it is an object of this invention to provide a process and apparatus for providing an improved structure which typifies slurry cast structure for forming into a desired article.

It is a further object of this invention to provide a process and apparatus for providing an improved structure as above having good rehabilitation.

It is a further object of this invention to provide a process and apparatus for providing an improved structure as above which when in a hot worked and reheated condition has finer particles and fewer eutectic melting rosettes than unworked, reheated slurry as-cast structures.

These and other objects will become more apparent from the following description and drawings.

Embodiments of the casting process and apparatus according to this invention are shown in the drawings wherein like numerals depict like parts.

FIG. 8 is a photograph of a slurry cast aluminum alloy A 357 which has been hot worked with a 60% reduction with the photograph taken at a magnification of 100×.

FIG. 9 is a photograph of the same material as in FIG. 8 after reheating to the semi-solid state and quenched with the photograph taken at a magnification of 100×.

In the background of this application, there have been described a number of techniques which may be used to form semi-solid thixotropic metal slurries for use in slurry casting. Slurry casting as the term is used herein refers to the formation of a semi-solid thixotropic metal slurry directly into a desired structure, such as a billet for later processing, or a die casting formed from the slurry.

The metal composition of a thixotropic slurry comprises islands of primary solid discrete particles enveloped by a solute-rich matrix. The matrix is solid when the metal composition is fully solidified and is a quasi-liquid when the metal composition is a partially solid and partially liquid slurry. The primary solid particles comprise degenerate dendrites or nodules which are generally spheroidal in shape. The primary solid particles are made of a single phase or a plurality of phases having an average composition different from the average composition of the surrounding matrix in the fully solidified alloy. The matrix itself can comprise one or more phases upon further solidification.

Conventionally solidified alloys have branched dendrites which develop interconnected networks as the temperature is reduced and the weight fraction of solid increases. In contrast, thixotropic metal slurries consist of discrete primary degenerate dendrite particles separated from each other by a quasi-liquid metal matrix potentially up to solid fractions of 95 weight percent. The primary solid particles are degenerate dendrites in that they are characterized by smoother surfaces and a less branched structure than normal dendrites, approaching a spheroidal configuration. The surrounding solid matrix formed during solidification of the liquid matrix subsequent to the formation of the primary solids contains one or more phases of the type which would be obtained during solidification of the liquid alloy in a more conventional process. The surrounding solid matrix comprises dendrites, single or multi-phase compounds, solid solution, or mixtures of dendrites, and/or compounds, and/or solid solutions.

The process and apparatus of the instant invention are readily adaptable to forming articles from a wide range of metals or metal alloys including but not limited to aluminum and its alloys, copper and its alloys, and iron and its alloys.

Figures 1, 3:
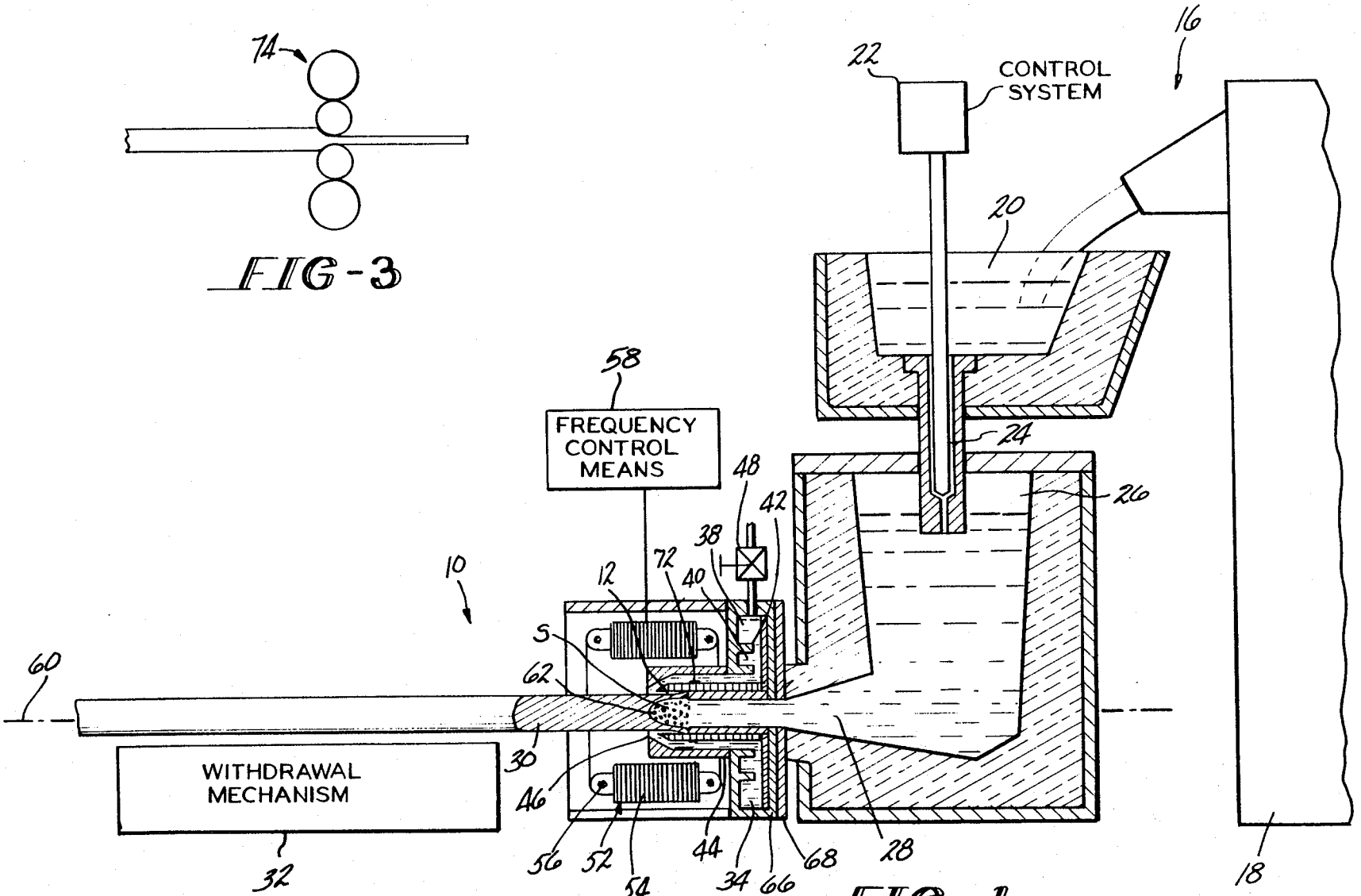
FIG. 1 is a schematic representation in partial cross section of an apparatus for casting a thixotropic semi-solid metal slurry in a horizontal direction.
FIG. 3 is a schematic representation of a rolling mill for hot working the continuous member formed by the slurry cast apparatus of FIG. 1.
Figure 2:
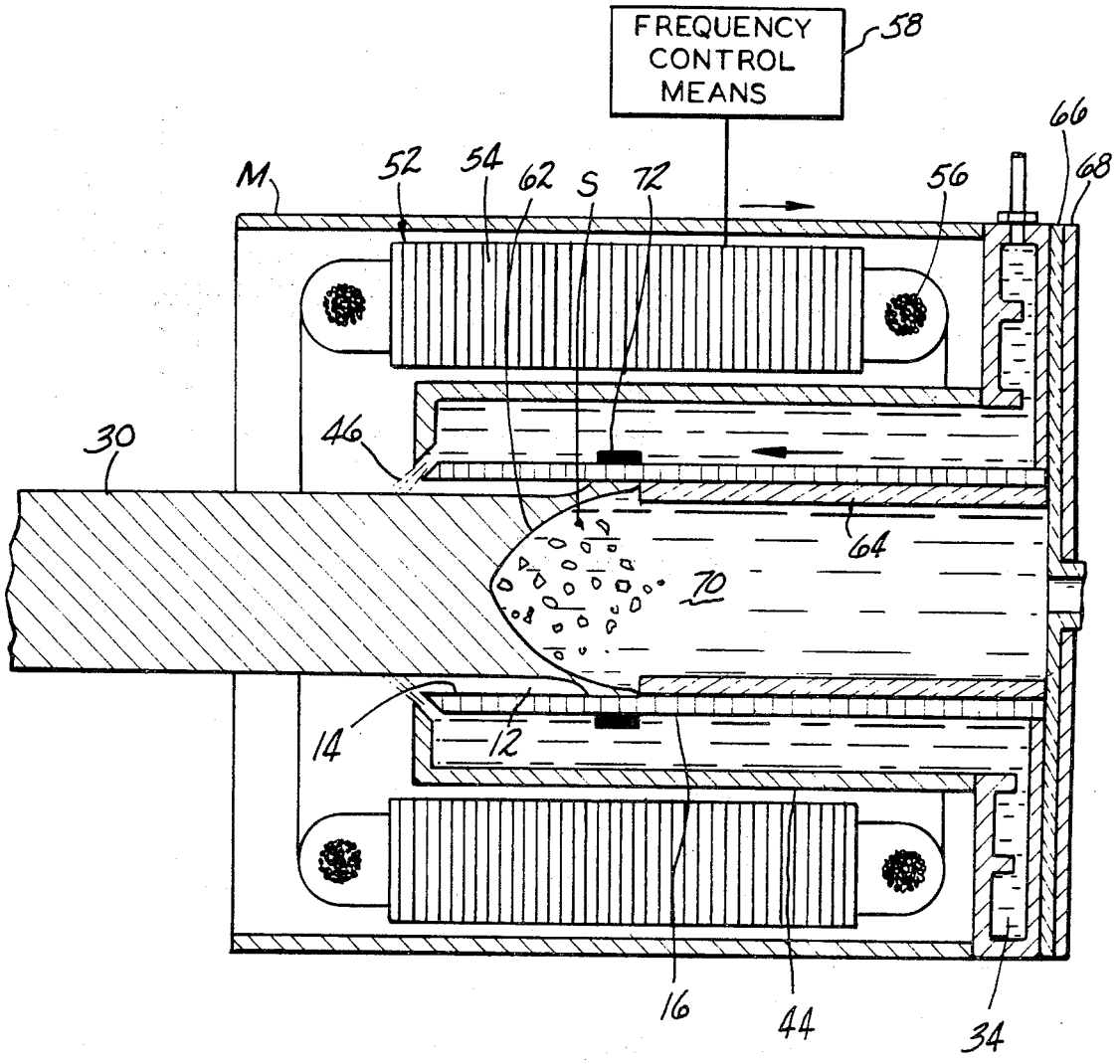
FIG. 2 is an enlarged view in cross section of the casting mold used in the apparatus of FIG. 1.
Figure 4:
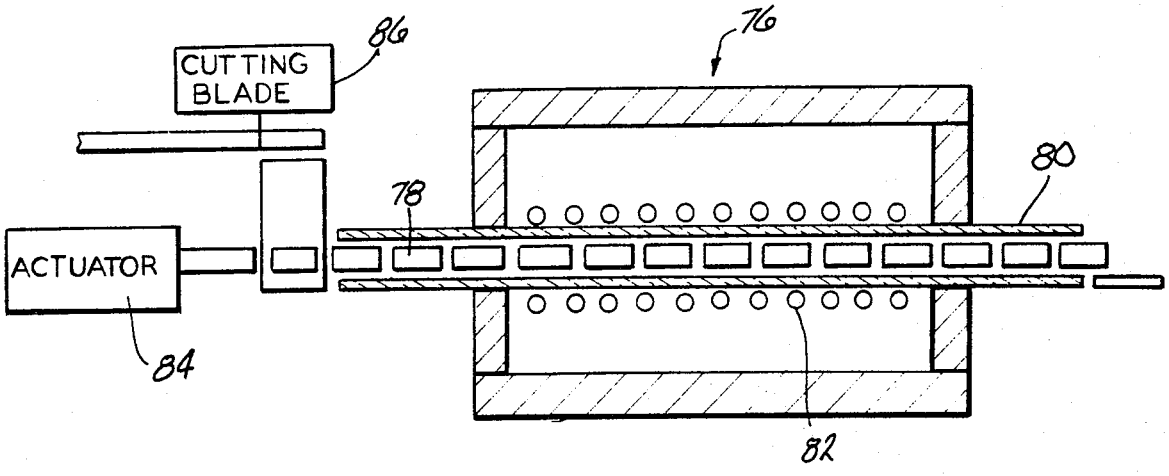
FIG. 4 is a schematic view in cross section of a furnace for reheating the hot worked material into a semi-solid state.
Figure 5:
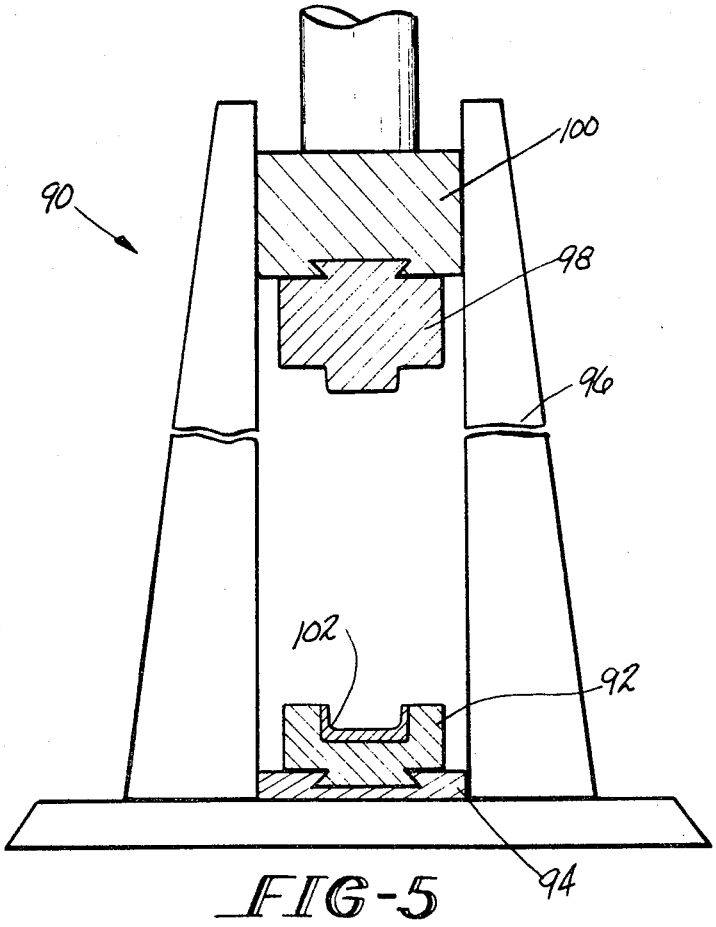
FIG. 5 is a schematic view in partial cross section of an apparatus for forming the material into a desired product.

Referring now to FIGS. 1 and 2, an apparatus 10 for continuously or semi-continuously slurry casting thixotropic metal slurries is shown. The cylindrical mold 12 is adapted for such continuous or semi-continuous slurry casting. The mold 12 may be formed of any desired non-magnetic material such as austenitic stainless steel, copper, copper alloys, aluminum, aluminum alloys, or the like.

The mold wall 14 preferably is cylindrical in nature. The apparatus 10 is particularly adapted for making cylindrical ingots utilizing a conventional two-pole polyphase induction motor stator for stirring. However, it is not limited to the formation of a cylindrical ingot cross section since it is possible to achieve transversely or circumferentially moving magnetic fields with a non-circular tubular mold arrangement not shown.

The molten material is supplied to mold 12 through supply system 16. The molten material supply system comprises the partially shown furnace 18, trough 20, molten material flow control system or valve 22, downspout 24 and tundish 26. Control system 22 controls the flow of molten material from trough 20 through downspout 24 into tundish 26. Control system 22 also controls the height of the molten material in tundish 26. Alternatively, molten material may be supplied directly through furnace 18 into tundish 26. The molten material exits from tundish 26 horizontally via conduit 28 which is in direct communication with the inlet to casting mold 12.

Solidifying casting or ingot 30 is withdrawn from mold 12 by a withdrawal mechanism 32. The withdrawal mechanism 32 provides the drive to the casting or ingot 30 for withdrawing it from the mold section. The flow rate of molten material into mold 12 is controlled by the extraction of casting or ingot 30. Any suitable conventional arrangement may be utilized for withdrawal mechanism 32.

A cooling manifold 34 is arranged circumferentially around the mold wall 14. The particular manifold shown includes a first input chamber 38 and a second chamber 40 connected to the first input chamber by a narrow slot 42. A coolant jacket sleeve 44 formed from a suitable material is attached to the manifold 34. A discharge slot 46 is defined by the gap between the coolant jacket sleeve 44 and the outer mold wall 16. A uniform curtain of coolant, preferably water, is provided about the outer mold wall 16. The coolant serves to carry heat away from the molten metal via the inner mold wall 14. The coolant exits through slot 46 discharging directly against the solidifying ingot. A suitable valving arrangement 48 is provided to control the flow rate of the water or other coolant discharged in order to control the rate at which the metal or metal alloy solidifies. In the apparatus 10, a manually operated valve 48 is shown; however, if desired, this could be an electrically operated valve or any other suitable valve arrangement.

The molten metal which is poured into the mold 12 is cooled under controlled conditions by means of the water flowing over the outer surface 16 of the mold 12 from the encompassing manifold 34. By controlling the rate of water flow along the mold surface 16, the rate of heat extraction from the molten metal within the mold 12 is in part controlled.

If desired, mold 12 may be provided with a system for supplying lubricant to the inner mold wall 14. The lubricant helps prevent the metal or metal alloy from sticking to the mold and assists in the heat transfer process by filling the gaps formed between the mold and the solidifying ingot as a result of solidification shrinkage. Any suitable system for providing lubricant to the inner mold wall may be utilized. The lubricant may comprise any suitable material and may be applied in any suitable form. In a preferred arrangement, the lubricant comprises rapeseed oil provided in fluid form. Alternatively, the lubricant may comprise powdered graphite, high temperature silicone, castor oil, other vegetable and animal oils, esters, paraffins, other synthetic liquids or any other suitable lubricant typically utilized in the casting arts. Furthermore, if desired, the lubricant may be injected as a powder which melts as soon as it comes into contact with the molten metal.

In order to provide a means for stirring a molten metal within the mold 12 to form the desired thixotropic slurry, a two-pole multi-phase induction motor stator 52 is arranged surrounding the mold 12. The stator 52 is comprised of iron laminations 54 about which the desired windings 56 are arranged in a conventional manner to preferably provide a three-phase induction motor stator. The motor stator 52 is mounted within the motor housing M. Although any suitable means for providing power and current at different frequencies and magnitudes may be used, power and current are preferably supplied to stator 52 by a variable frequency generator 58. The manifold 34 and the motor stator 52 are arranged concentrically about the axis 60 of the mold 12 and the casting 30 formed within it.

It is preferred to utilize a two-pole three-phase induction motor stator 52. One advantage of the two-pole motor stator 52 is that there is a non-zero field across the entire cross section of the mold 12. It is, therefore, possible within this invention to solidify a casting having the desired slurry cast structure over its full cross section.

The magnetic stirring force generated by the magnetic field created by motor stator 52 extends generally tangentially of inner mold wall 14. This sets up within the mold cavity a rotation of the molten metal which generates the desired shear for producing the thixotropic slurry S. The magnetic stirring force vector is normal to the heat extraction direction and is, therefore, normal to the direction of dendrite growth. By obtaining a desired average shear rate over the solidification range, i.e. from the center of the slurry to the inner mold wall 14, an improved shearing of the dendrites as they grow may be obtained.

The stirring of the molten metal and the shear rates are functions of the magnetic induction at the periphery of the molten material. The mold is preferably made from a material having a high thermal conductivity in order to have the heat transfer characteristics required to effect solidification. Prior art molds are typically made of a thermally conductive material which tends to absorb significant portions of the induced magnetic field. This mold absorption effect increases and the frequency of the inducing current increases. As a result, prior art casting systems have been limited in the frequencies which they may utilize to operate efficiently. However, this problem may be overcome by using a laminated mold structure such as that shown in U.S. Patent Application Ser. No. 289,572, filed August 3, 1981 and now U.S. Pat. 4,457,354 issued July 3, 1984 to Dantzig et al.

It is preferred that the stirring force field generated by the stator 52 extends over the entire solidification zone of the molten metal and thixotropic metal slurry S. Otherwise, the structure of the casting will comprise regions within the field of the stator 52 having a slurry cast structure and regions outside the stator field tending to have a non-slurry cast structure. In the embodiment of FIG. 1, the solidification zone preferably comprises a sump of molten metal in slurry S within the mold 12 which extends from the mold inlet to the solidification front 62 which divides the solidified casting 30 from the slurry S. The solidification zone extends at least from the region of the initial onset of solidification and slurry formation in the mold cavity to the solidification front 62.

Under normal solidification conditions, the periphery of the ingot 30 will exhibit a columnar dendritic grain structure. Such a structure is undesirable and detracts from the overall advantages of the slurry cast structure which occupies most of the ingot cross section. In order to eliminate or substantially reduce the thickness of this outer dendritic layer, the thermal conductivity of the inlet region of the mold may be reduced by means of a partial mold liner 64 formed from an insulator such as a ceramic. The ceramic mold liner 64 extends from the insulating liner 66 of the mold cover 68 down into the mold cavity 70 for a distance sufficient so that the magnetic stirring force field of the two-pole motor stator is intercepted at least in part by the partial ceramic mold liner. The ceramic mold liner 64 is a shell which conforms to the internal shape of the mold 12 and is held to the mold wall 14. The mold 12 comprises a structure having a low heat conductivity inlet portion defined by the ceramic liner and a high heat conductivity portion defined by the exposed portion of the mold wall 14.

The liner 64 postpones solidification until the molten metal is in the region of the strong magnetic stirring force. The low heat extraction rate associated with the liner generally prevents solidification in that portion of the mold 12. Generally, solidification does not occur except towards the downstream end of the liner or just thereafter. This region or zone of low thermal conductivity thereby helps to result in slurry cast ingot 30 having a degenerate dendritic structure throughout its cross section even up to its outer surface.

If desired, the initial solidification of the ingot shell may be further controlled by moderating the thermal characteristics of the casting mold. In a preferred manner, this is achieved by selectively applying a layer or band 72 of thermally insulating material on the outer wall or coolant side of the mold 12. The thermally insulating layer or band 72 retards the heat transfer through mold 12 and thereby tends to slow down the solidification rate and reduce the inward growth of solidification.

Below the region of reduced thermal conductivity, the water cooled metal casting mold wall 14 is present. The high heat transfer rates associated with this portion of the mold 12 promote ingot shell formation. However, because of the zone of low heat extraction rate, even the peripheral shell of the casting 30 could consist of degenerate dendrites in a surrounding matrix.

It is preferred, in order to form the desired slurry cast structure at the surface of the casting, to effectively shield any initial solidified growth from the mold liner. This can be accomplished by insuring that the field associated with the motor stator 52 extends over at least that portion at which solidification is first initiated.

The dendrites which initially form normal to the periphery of the casting mold 12 are readily sheared off due to the metal flow resulting from the rotating magnetic field of the induction motor stator 52. The dendrites which are sheared off continue to be stirred to form degenerate dendrites until they are trapped by the solidifying interface. Degenerate dendrites can also form directly within the slurry because the rotating stirring action of the melt does not permit preferential growth of dendrites. To insure this, the stator 52 length should preferably extend over the full length of the solidification zone. In particular, the stirring force field associated with the stator 52 should preferably extend over the full length and cross section of the solidification zone with a sufficient magnitude to generate the desired shear rates.

To form a slurry casting 30 utilizing the apparatus 10 of FIG. 1, molten metal is poured into the mold cavity while motor stator 52 is energized by a suitable three-phase AC current of a desired magnitude and frequency. After the molten metal is poured into the mold cavity, it is stirred continuously by the rotating magnetic field produced by stator 52. Solidification begins from the mold wall 14. The highest shear rates are generated at the stationary mold wall 14 or at the advancing solidification front. By properly controlling the rate of solidification by any desired means as are known in the prior art, the desired thixotropic slurry S is formed in the mold cavity. As the solidifying shell is formed on the casting 30, the withdrawal mechanism 32 is operated to withdraw casting 30 at a desired casting rate.

The apparatus 10 is capable of casting a continuous member such as a bar, rod, wire, etc. having any desired radius and any desired length. After casting, the ingot 30 is transferred by any suitable conventional transfer system to a heating system not shown. The heating system may comprise any heating means as are known in the art for rapidly elevating the temperature of a casting. Within the heating system, the ingot 30 is heated to a temperature above that at which center bursts or edge cracks form and below that at which the alloy system forming the ingot homogenizes during reheating. It should be recognized that the temperature to which the ingot 30 is heated depends upon the metal or alloy forming the ingot 30. For slurry cast aluminum alloys, the temperature should be in the range of about 600° F. to about 1000° F., preferably about 700° F. to about 850° F.

Thereafter, the heated ingot is transferred to a suitable apparatus 74 such as a rolling mill for working. The hot working operation is preferably carried out so that there is a total reduction in cross-sectional area of the ingot from about 40 percent to about 98 percent, preferably about 60 percent to about 96 percent.

If the material being hot worked is to be later used in a hot forming operation, it is preferable that hot working be carried out in a manner that does not engender substantially any homogenization.

If desired, the ingot 30 may be reheated and worked in cycles as long as the time and temperature period is short. When the working operation is performed by a rolling mill, any suitable rolling mill such as a two-high mill, four-high mill, etc. may be used. The rolling mill may have any suitable roll arrangement.

While the hot working apparatus 74 has been described in terms of a rolling mill, it should be recognized that other apparatuses such as forging, swaging, extrusion, etc. may be used in lieu of a rolling mill.

Figure 6:
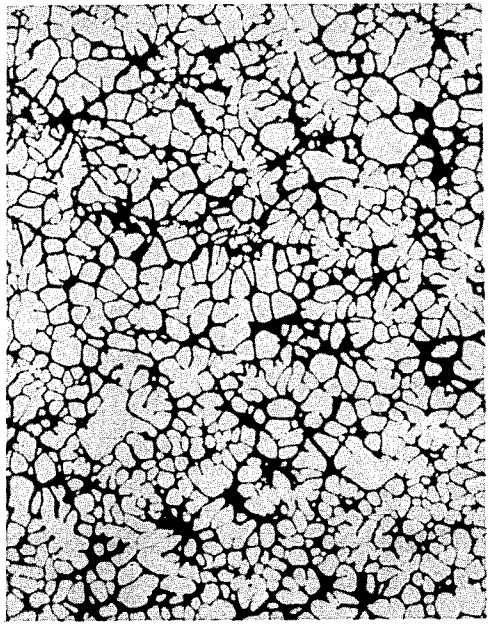
FIG. 6 is a photograph of a slurry cast aluminum alloy A 357 in the as-cast condition with the photograph taken at a magnification of 100×.

It has been surprisingly discovered that the slurry as-cast structure is deformable after hot working. FIG. 6 shows slurry cast aluminum alloy A 357 in an as-cast condition. FIG. 8 shows the same slurry cast aluminum alloy in a hot worked condition. By comparing these two photographs, the deformed grain particles exhibiting directionally of the hot worked slurry cast structure can be seen. It is believed that the deformed structure is retained by the high precentage of eutectic in this alloy.

After the slurry cast ingot has been hot worked, it is transferred by any suitable means not shown to an apparatus 76 for reheating the slurry cast material to a semi-solid state. If desired, prior to entering the reheating apparatus, ingot 30 may be cut into slugs or blanks 78 having any desired length. Any suitable cutting device 86 may be used to cut the ingot 30 into suitable slugs or blanks. The cutting device 86 may comprise any conventional apparatus for cutting a continuous member such as a flying shear blade for hot or cold shearing, a sawing blade, etc.

Reheating apparatus 76 may comprise an induction heating furnace. Within such a furnace, the material passes through a refractory insulator 80 surrounded by an induction coil 82. The induction coil 82 is connected to a source of electrical power not shown so that electric current is carried by the tubing. Any suitable actuator 84 as is known in the art may be used to cause the material to pass through the furnace. In lieu of an induction furnace, any suitable conventional furnace or heating apparatus known in the art such as pulse heating, $I^2R$ heating, etc. may be used.

The temperature to which the material is heated should be between the liquidus and solidus for the metal or alloy forming the ingot 30. It is desirable, however, that the material be heated to a temperature at which it is in a semi-solid state preferably having a fraction solid to liquid of about 20 to about 95 percent, preferably about 50 to about 85 percent. It is also desirable that the temperature to which the material is heated be achieved rapidly so that the material retains as fine a structure as possible. A fine structure rather than a coarse structure is desired since coarse structures have a higher viscosity. It should also be noted that rapid heating is desirable since the heating process competes against homogenization of the metal or alloy forming the ingot 30.

It has surprisingly been discovered that upon reheating material subjected to hot working shows a return to a typical slurry as-cast structure. FIG. 9 shows a slurry cast material in a hot worked and reheated condition. By comparing FIG. 9 with FIG. 8, the rehabilitation of the material can be seen. It can be said that the hot worked and reheated structures show an unexpectedly high degree of integrity or good rehabilitation as compared with unworked and reheated structures. Generally, greater reductions show progressive improvements in rehabilitation in the structures after reheating. In some hot worked structures, not only will rehabilitation occur, but the new structure is very fine and nearly free of eutectic melting rosettes.

After reheating, the material while still in a semi-solid state may be passed to a forming apparatus 90 by a suitable transfer system not shown. The forming apparatus 90 may comprise any suitable apparatus such as a closed die forging means. The forging apparatus has a lower die 92 located within an anvil cap 94 mounted to a frame 96. The metal alloy in the form of the reheated material in a semi-solid state is placed in the lower die 92. An upper die 98 is connected to a weighted ram 100. The ram 100 may be actuated by any conventional system, such as an air lift system, a hydraulic system, a board system, etc. The ram is raised by the actuator not shown to a desired position and then dropped. The striking force imposed by the upper die 98 and the weighted ram 100 cause the metal material to deform and produce a desired article 102. The dies 92 and 98 may have any desired configuration suitable for producing any desired article. By providing a hot worked, reheated slurry cast structure with finer grain particles than a reheated slurry as-cast structure, the forming operation can be conducted more efficiently. A material having a finer particle structure has a lower viscosity as compared to a material having a coarser structure. In lieu of a closed die forging apparatus, any other suitable forming apparatus such as an open die forging apparatus, a casting apparatus, etc. may be used.

If desired, the article may be subjected to a quenching operation after forming. Any suitable apparatus as are known in the art for quenching may be utilized.

In order that the invention may be more fully understood, the following examples are given by way of illustration.

EXAMPLE I

A 2-½" diameter bar of alloy AA 6061 was slurry cast at a casting rate of about 10 inches per minute, a stator current of about 20 to 25 amps, and a frequency of about 60 Hz. A length of the slurry cast bar was hot rolled at a starting temperature of about 750° F. through a series of diamond oval profile roll openings. The final cross-sectional dimensions were an oval 1.5"×1.7" and the total reduction in cross-sectional area was about 60 percent. This bar was then reheated and quenched. Quenching was performed to freeze in the reheated structure. The hot worked and reheated structure showed good rehabilitation. Rehabilitation is defined as the extent to which the reheated structure shows envelopment of the primary $\alpha$ aluminum phase by the secondary phases. A comparison was made with a sample of as-cast, reheated and quenched parent bar. The hot worked and reheated structure showed finer particles and fewer eutectic melting rosettes when compared with the as-cast, reheated and quenched parent bar structure.

EXAMPLE II

Figure 7:
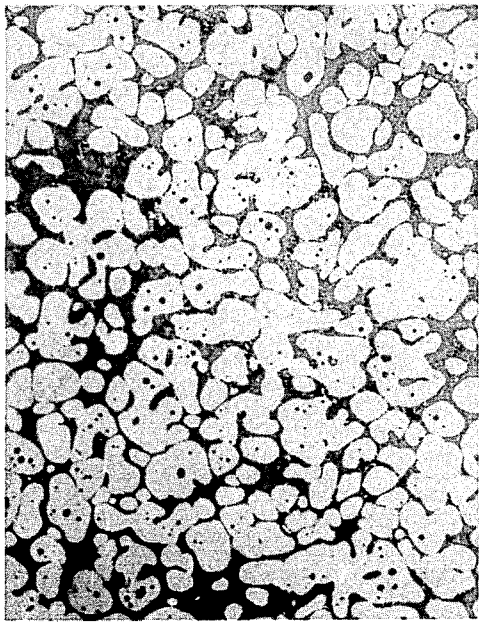
FIG. 7 is a photograph of the same material as in FIG. 6 after reheating to the semi-solid state and quenched with the photograph taken at a magnification of 100×.

A 2" diameter bar of aluminum alloy A357 was slurry cast at a casting rate of about 40 inches per minute, a stator current of about 10 amps and a frequency of about 300 Hz. A length of the bar was machined to approximately 1½" diameter and hot rolled at a starting temperature of about 700° F. to a total reduction in cross-sectional area of about 60 percent. The length of bar was then reheated to the semi-solid state and quenched. The structure of the material as slurry cast and hot worked is shown in FIG. 8. The structure of the same material after reheating to the semi-solid condition and quenched is shown in FIG. 9. Comparison of these figures show that the worked and reheated structure exhibits good rehabilitation. A similar pair of photomicrographs for the same material but in the as-cast and as-cast and reheated/quenched state are shown in FIGS. 6 and 7. By comparing FIG. 7 to FIG. 9, it can be seen that there are finer particles and fewer eutectic melting rosettes in the hot worked/reheated structure as compared to the as-cast/reheated structure.

The above examples show that hot working is a practical and advantageous method for producing a wide variety of feed stock sizes. Hot working has no adverse effect on rehabilitation and with higher reductions progressively refines the primary particle size. Furthermore, the new structure is substantially free of eutectic melting rosettes. While one can speculate that it is likely a surface energy effect which results in the rehabilitation of the worked structure, the appearance of a finer structure at high deformation is not readily explained. It may be possible that recrystallization to a finer grain structure on reheating to a semi-solid state may encourage the molten eutectic to find new interparticulate low energy configurations. In the process, most minor dendricity of the structure is eliminated, thus precluding eutectic melting rosette formation.

In aluminum alloy A357 the solute network which constitutes some 40%–50% of the structure consists principally of Al-Si eutectic not subject to dissolution by homogenization or heating below or above the solidus. It was surprising that considerable hot working could be imposed on an alloy which contains so large a volume fraction of eutectic. Very likely, it is the spheroidization of the eutectic at rolling temperature which permits excessive deformation. Attentuation or loss of continuity of this network is not a problem during working operations.

The particular parameters employed can vary from metal system to metal system. The appropriate parameters for alloy systems other than the aluminum alloys described above can be determined by routine experimentation in accordance with the principles of this invention.

Solidification zone as the term is used in this application refers to the zone of molten metal or slurry in the mold wherein solidification is taking place.

Magneto-hydrodynamic as the term is used herein refers to the process of stirring molten metal or slurry using a moving or rotating magnetic field. The magnetic stirring force may be more appropriately referred to as a magnetomotive stirring force which is provided by the moving or rotating magnetic field of this invention.

While a horizontal slurry casting system has been shown herein, a slurry casting system having a vertical orientation or any other suitable orientation may be utilized.

The patents, patent applications, and articles set forth in this specification are intended to be incorporated by reference herein.

It is apparent that there has been provided in accordance with this invention a process and apparatus for producing improved slurry casting structures by hot working which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. A process for providing metal material having an improved structure for forming into a desired article, said process comprising:

slurry casting said metal material into a continuous member having an initial cross-sectional area and a structure comprising islands of solid particles enveloped by a solute-rich matrix; and hot working said slurry cast material while in a solid state to reduce said cross-sectional area, said hot working causing said particles to deform, heating said hot worked material for a desired period of time at a temperature sufficient to place said material into a semi-solid state, whereby said material substantially rehabilitates to a typically slurry cast structure and exhibits finer particles and fewer eutectic melting rosettes than said slurry as-cast material in a heated and unworked condition.

2. The process of claim 1 wherein said step of hot working further comprises:

hot working said slurry cast material without engendering substantially any homogenization.

3. The process of claim 1 further comprising:

forming said semi-solid material into said desired article.

4. The process of claim 1 wherein said hot working step comprises:

heating said slurry cast material to a desired temperature; and hot rolling said heated slurry cast material to obtain said cross-sectional area reduction.

5. The process of claim 4 wherein:

said metal material comprises a material consisting essentially of aluminum; and said heating step comprises heating said slurry cast material to a temperature in the range of about 600° F. to about 1000° F.

6. The process of claim 5 wherein said heating step comprises:

heating said slurry cast material in a temperature range of about 700° F. to about 850° F.

7. The process of claim 1 wherein said step of hot working comprises:

reducing said initial cross-sectional area by about 40 percent to about 98 percent.

8. The process of claim 7 wherein said hot working step comprises:

reducing said cross-sectional area by about 60 percent to about 96 percent.

* * * * *